US007237699B2

(12) United States Patent
Zill et al.

(10) Patent No.: US 7,237,699 B2
(45) Date of Patent: Jul. 3, 2007

(54) FILTER PISTON APPARATUS FOR DISPENSING PULVERULENT BULK MATERIAL

(75) Inventors: Tobias Zill, Hattenhofen (DE); Manfred Reiser, Winnenden (DE)

(73) Assignee: Harro Hofliger Verpackungsmaschinen GmbH, Allmersbach Im Tal (DE)

( * ) Notice: Subject to any disclaimer, the term of this patent is extended or adjusted under 35 U.S.C. 154(b) by 499 days.

(21) Appl. No.: 10/866,071

(22) Filed: Jun. 10, 2004

(65) Prior Publication Data

US 2005/0023297 A1 Feb. 3, 2005

(30) Foreign Application Priority Data

Jun. 12, 2003 (DE) ..... 203 09 279 U
Jul. 7, 2003 (DE) ..... 103 30 771

(51) Int. Cl.
*A01C 15/04* (2006.01)
*B01D 46/18* (2006.01)

(52) U.S. Cl. ..... 222/636; 222/189.06; 222/368; 55/407

(58) Field of Classification Search ..... 222/189.06, 222/636, 630, 205, 368, 429, 427, 367, 370, 222/335, 309, 185.1, 430, 181.1, 332; 210/483, 210/484, 488, 500.26, 500.25, 491, 503, 210/504, 508, 496, 490, 498; 55/407
See application file for complete search history.

(56) References Cited

U.S. PATENT DOCUMENTS

| | | | | |
|---|---|---|---|---|
| 2,540,059 | A * | 1/1951 | Stirn et al. | 141/1 |
| 4,350,049 | A | 9/1982 | Gupte et al. | |
| 4,371,101 | A | 2/1983 | Cane et al. | |
| 4,437,294 | A | 3/1984 | Romagnoli | |
| 4,509,568 | A | 4/1985 | Kawaguchi et al. | |
| 4,662,915 | A | 5/1987 | Shirai et al. | |
| 4,709,837 | A | 12/1987 | Erdman | |

FOREIGN PATENT DOCUMENTS

| | | |
|---|---|---|
| GB | 1420364 | 4/1973 |
| WO | WO-8302434 | 7/1983 |

* cited by examiner

*Primary Examiner*—Kevin Shaver
*Assistant Examiner*—Stephanie E. Tyler
(74) *Attorney, Agent, or Firm*—Darby & Darby

(57) ABSTRACT

A filter piston apparatus that dispenses predetermined volumes of pulverulent bulk material has a metering chamber which accommodates in each case a predetermined volume of bulk material, which is present at the end of a circular-cylindrical bore and which has its base formed by a filter of the piston. The metering chamber is attached to a positive-pressure or negative-pressure gas source through the filter, which is permeable to gas but impermeable to the bulk material. A piston wall has a transverse slot and an inner groove located radially opposite the transverse slot, such that the filter can be pushed into the slot from the outside and, when seated in the piston, can be secured on both sides in the axial direction of the piston along it periphery.

24 Claims, 4 Drawing Sheets

FIG. 3
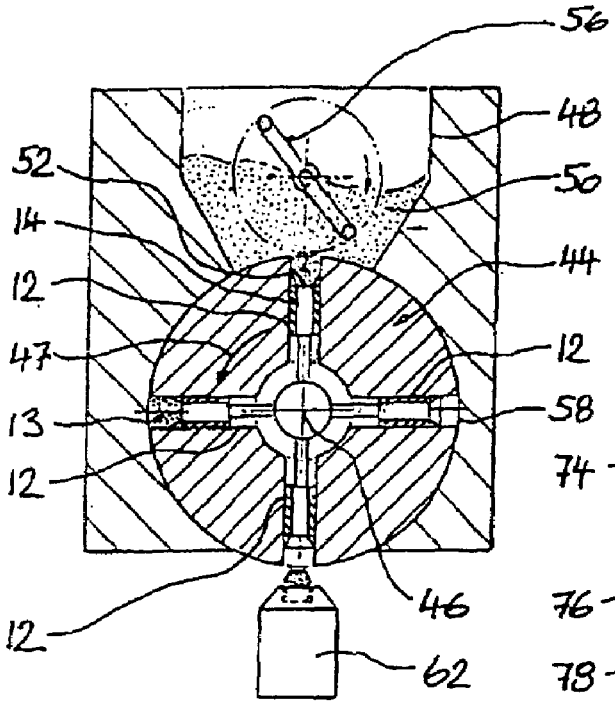
FIG. 4
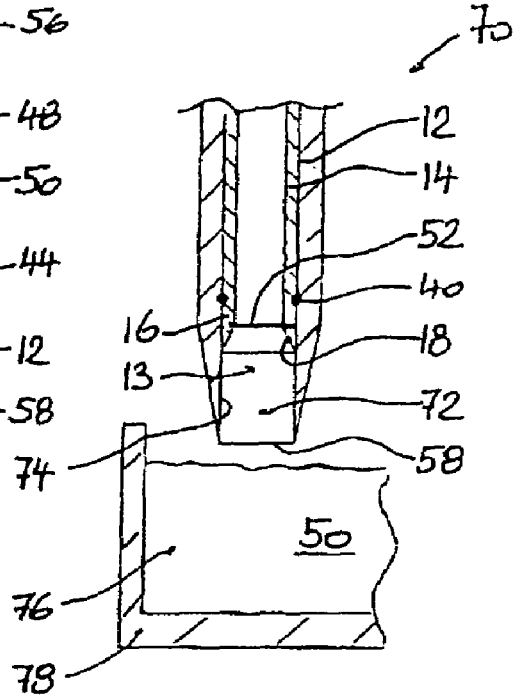
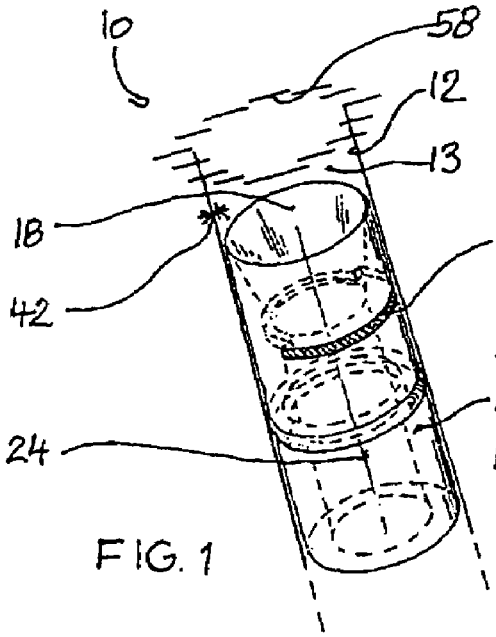
FIG. 1
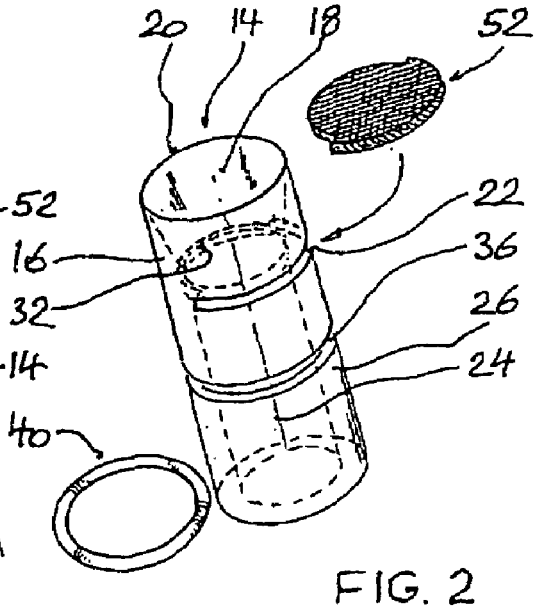
FIG. 2

FIG. 5
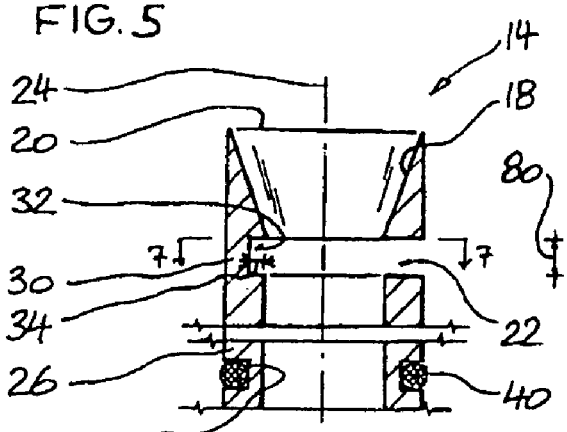
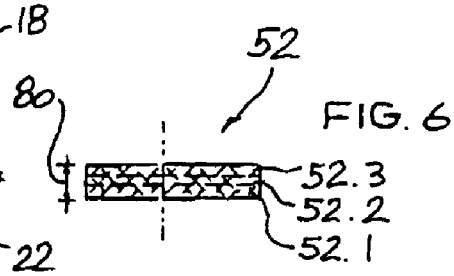
FIG. 6
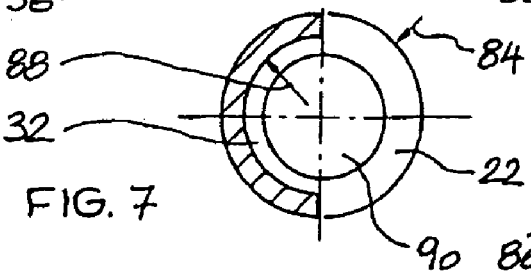
FIG. 7
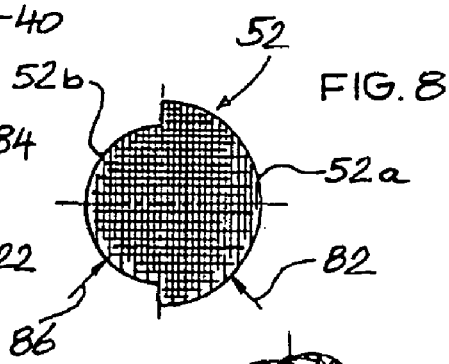
FIG. 8
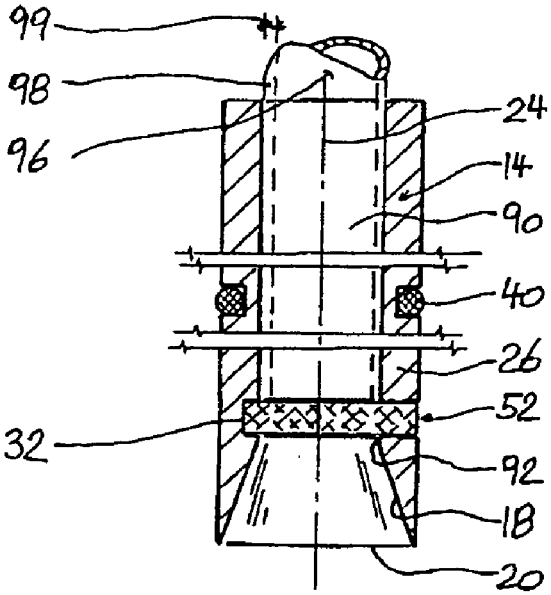
FIG. 9
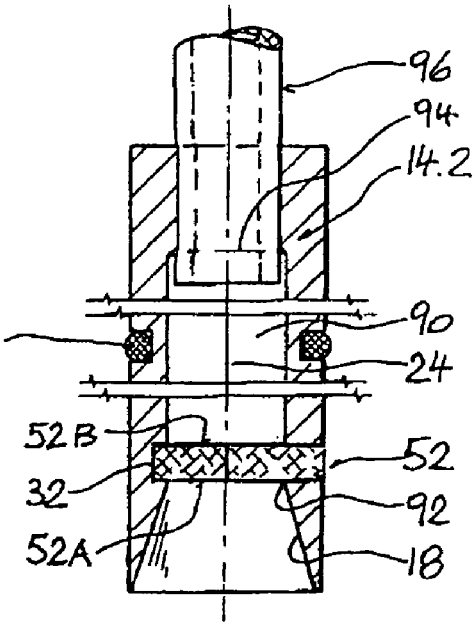
FIG. 10

FILTER PISTON APPARATUS FOR DISPENSING PULVERULENT BULK MATERIAL

TECHNICAL FIELD

The invention relates to a filter piston apparatus for dispensing a predetemined, approximately constant volume of pulverulent bulk material. By means of the filter piston apparatus, the volume of pulverulent bulk material which is to be dispensed in each case is introduced into a metering chamber and retained there in a force fitting manner as the filter piston apparatus is transported to a container which is to be filled in each case. The pulverulent bulk material which is present in the metering chamber is then emptied, by the filter piston apparatus, into the correspondingly available container. For the purpose of filling the metering chamber, pulverulent bulk material is sucked into the metering chamber, and it is blown out of the metering chamber when the latter is emptied. For this purpose, a negative air pressure or positive air pressure may be generated in the interior of the metering chamber.

Such filter piston apparatuses may be designed as so-called metering tubes or metering rollers. Whereas a metering tube, for filling purposes, is inserted from above into a stationary bed of bulk material, the metering chambers, which are distributed over the outer circumference of a metering roller, are positioned one after the other beneath the base opening of a bulk-material container during the respective filling operation. More specific details relating to the respective constructions of the different filter piston apparatuses can be gathered from the description of the figures.

PRIOR ART

GB 1 420 364 discloses a filter piston apparatus in the manner of a metering tube. The filter plate, which forms the base of the metering chamber, is designed as a membrane. The membrane is welded circumferentially to the end surface of a hollow cylindrical body. At its end which is located opposite to the filter plate, this hollow body has a claw-like formation which fits together, in the manner of a coupling, with a claw-like formation of a further hollow body such that the two hollow bodies can be plugged onto one another. The membrane, which butts against the end surface of the hollow body, has, as a result of its periphery bearing against the end surface of the hollow body, a circular surface which is in contact with the bulk material and is larger than the (rear) membrane surface which is subjected to the action of the positive air pressure when the bulk material is blown out. The bulk material which is taken in against the membrane during the introduction operation thus cannot be blown out in its entirety. In particular, bulk material in the form of fine-grained powder with a grain size of less than 100 micrometers usually give rise to the effect where accumulations of material form in the base corners of the metering chamber. These accumulations of material are not blown out of the metering chamber in their entirety during the blowing-out operation, and therefore prevent the metering chamber from being completely emptied during the blowing-out operation. This impairs the metering accuracy of this dispensing apparatus.

A further filter piston apparatus in the manner of a metering tube is known from EP 0 029 186 B1. This apparatus dispenses fine-grained, micronized powders in extremely small quantities. The cylindrical wall and the base of the metering chamber of the metering tube are of air-permeable design. However, as a result of this configuration, uniform air movement may not be ensured over the entire filter surface, on the one hand, when powder is sucked in and, on the other hand, when the powder is blown out. Moreover, the filter, which is designed as a hollow body, is difficult to access, and thus involves very high outlay in order to be removed and installed, for example, for cleaning purposes.

In the case of the metering-roller-type filter piston apparatus which is known from DE 30 40 659 A1, the respective base of the metering chambers, which are present in the circumference of the roller, comprises an air-permeable filter. This filter is tensioned over the end surface of a hollow cylinder. As a result, as in the case of the abovementioned metering tubes, the filter surface which is covered by the bulk material which is taken in is larger than the (rear) filter surface which is subjected to the action of air during the blowing-out operation. It is thus possible for accumulations of material to form in the base periphery of the filter chamber, these accumulations of material not being blown out in their entirety during the blowing-out operation. This problem is also present in the case of the metering roller which is known from DE 31 15 589 A1.

The filter unit in the case of the metering roller which is known from U.S. Pat. No. 4,709,837 is designed in a manner similar to the abovementioned GB 1 420 364. Here too, a hollow-cylindrical filter element containing a filter plate is present such that it can be fitted on a further hollow body. The filter plate is retained in a non-releasable manner between two hollow-cylindrical shaped parts of the filter element which have been plugged one inside the other. The two hollow-cylindrical shaped parts have a perforated base. Said filter plate is fixed in position between the two perforated bases. In the case of this filter, the pulverulent bulk material which is to be dispensed in each case can thus also pass into those regions of the filter plate which are located between axially adjacent perforated walls of the two hollow-cylindrical shaped parts. It is not possible to control, for all practical purposes, whether, and how much, pulverulent bulk material is sucked into the annular perforated-wall regions and blown out again, with the result that impairment to the precision of the respective dispensing quantities is unavoidable.

In the case of WO 83/02434, the metering chambers formed in the metering roller are closed by a filter base which is retained in a hollow cylinder such that it can be displaced on a central rod. As a result of the central rod, the filter surface which is subjected to the action of pulverulent bulk material has a larger surface area than the rear filter surface located opposite. It is thus not possible for the bulk material sucked into the filter to be subjected uniformly to the action of air over the entire filter surface, and thus to be blown uniformly out of the filter chamber; this is because a central base region located opposite the rod is subjected in an undefined manner to the action of air.

The filter medium of a filter piston apparatus which is known from EP 0 172 642 B1 is a sintered body which is connected, such that it cannot be released intact, to a piston which forms the base of the metering chamber. This known filter is relatively costly to remove and clean.

In the case of the metering roller which is known from U.S. Pat. No. 2,540,059, each metering chamber has a filter which is fastened on the end surface of a base-forming tube and which closes the tube in an air-permeable or gas-permeable manner at the end. The end surface of this tube, in turn, results in the useable, axially opposite filter surfaces being of different sizes, which, in turn, results in the above-mentioned dispensing inaccuracy.

Finally, DE 33 28 820 C2 discloses a dispensing apparatus of the generic type for granular material. This dispensing apparatus is designed as a metering roller. Seated in the metering-roller end bore which defines the respective metering chamber is a multi-part hollow-cylindrical body of highly structured shape. A plate-like filter is placed between two of the axially joined-together hollow-cylindrical bodies. Although the filter is releasable and thus removable, the large number of parts which are to be assembled results in the assembly outlay being very high.

DESCRIPTION OF THE INVENTION

Taking this prior art as the departure point, the object of the invention is to specify a filter piston apparatus for dispensing pulverulent bulk material which allows, as far as possible, constant quantities of pulverulent bulk material to be dispensed. Nevertheless, this filter piston apparatus is to be capable of being operated as cost-effectively as possible.

This invention is achieved by the features of claim 1. Expedient developments of the invention form the subject matter of further claims which follow claim 1.

The filter piston apparatus according to the invention has a comparatively small number of components, which are of straightforward configuration. By virtue of the piston being plugged to different extents into the circular-cylindrical bore provided for it, the size of the metering chamber can be variably adjusted in a very straightforward manner. It is also possible for the filter to be pushed into the hollow-cylindrical piston from the side, and drawn out laterally again from the slot provided therefor, in a very straightforward and thus cost-effective manner. The operations of cleaning or replacing a no longer useable filter are thus desirably straightforward.

Configuring the hollow-cylindrical piston with a slot allows a single-piece piston casing.

The wall of the metering chamber encloses, within the hollow-cylindrical piston, a frustoconical interior, which increases in cross section toward the end surface of the piston. It is thus possible for the pulverulent bulk material which is taken into the filter to be blown out in its entirety from the region of the hollow-cylindrical piston. It is advantageous here to have an, as far as possible, sharp-edged end region of the hollow-cylindrical piston and thus of the wall of the metering chamber within the piston. The hollow-cylindrical piston may be seated in a sealed manner in the circular-cylindrical bore of the respective filter piston apparatus by means of a seal, which may be designed in particular as an O-ring. This circular-cylindrical bore may be present both in a metering tube and in the body of a metering roller or in similar components of such so-called vacuum filling systems.

In particular the piston seal, which is designed as an O-ring, will be seated in an encircling transverse groove of the piston. There is thus no need for any formations in the circular-cylindrical bore of the metering tube or of the metering roller. Apart from such a transverse groove which may be present, the piston can have a smooth, non-structured surface.

Since it can be pushed into the inner groove of the piston from the inside, the filter, as seen in plan view, has, at least in one sub-region, a partially circular surface of which the radius is no greater than the internal radius of the piston in the region of the groove base. The filter may have a circular surface overall as seen in plan view. In this case, rather than terminating flush with the outside of the piston in the region of the slot, it is seated in a sunken manner therein in the region of the slot. It is also possible for the filter to terminate flush with the outside of the piston or even to project some way out of the outer clearance profile of the piston. The projecting region of the filter may then assist the (partial) sealing of the gap between the hollow-cylindrical piston and the circular-cylindrical bore in which the piston is seated. At least in this case, the filter, as seen in plan view, is made up of at least two partially circular surfaces of which the radii are of different magnitudes such that the filter can be pushed into the inner groove of the piston—as before—by way of its smaller partially circular surface.

In order to ensure that the filter is reliably pushed right into the slot, it is advantageous for the radius of the partially circular surface of the filter which is pushed into the inner groove to be selected to be equal to the internal radius of the groove base. This is because the precise fit of the filter in the piston can then be easily established by simply pushing the filter all the way into the slot only until it strikes against the groove base.

The filter may consist of a non-elastic material, in particular of sintered glass or sintered metal.

The thickness of the filter is expediently adapted to the axial height of the transverse slot and of the transverse groove such that the filter can be pushed with a sliding fit in and out of the transverse slot and of the transverse groove of the piston.

The filter may also be designed in the manner of a support with an attached filter medium. The filter medium here may consist of a non-elastic material, in particular of sintered glass or sintered metal. The filter medium or the filter as a whole may comprise a plurality of differently permeable filter layers. In this case, the filter layer with the finest pores is directed toward the interior of the metering chamber.

The filter or its filter medium may also be elastically compressible. The thickness of the filter or of the filter provided with the filter medium here is advantageous such that the filter can be pushed with a sliding fit into the transverse slot and into the transverse groove.

The filter or just the filter medium thereof may consist of felt material or contain felt material. Instead of the felt material, it is also possible to use a nylon fabric.

In order to keep the level of deformation of axially elastic filter medium as low as possible, a support which retains the relevant filter medium may be designed, as far as possible, to have a dimensionally stabilizing effect on the filter medium. More specific details relating to this can be gathered from the exemplary embodiments.

In order to prevent pulverulent bulk material from penetrating into the filter from the outside through the piston-enclosing annular gap, it is recommended for the radially outer surface of the filter to be designed to be impermeable to the bulk material, in particular air-impermeable. This impermeability can be achieved by a corresponding coating of the filter. Furthermore, it is also possible, this being additionally illustrated in an exemplary embodiment, for a sealing element which is impermeable to the bulk material, for example a sealing element in the form of a ring section, to be introduced into the transverse slot of the piston in addition to the filter. This ring section is present in the cross-sectional region of the piston wall and does not reduce the size of the through-passage opening of the piston and thus the effective filter surfaces of the filter on both sides. Such a sealing element can effectively prevent bulk material from penetrating laterally and radially into the filter medium.

Further configurations and advantages of the invention can be gathered from the features further cited in the claims and from the exemplary embodiments illustrated in the drawing.

BRIEF DESCRIPTION OF THE DRAWING

The invention is explained and described in detail hereinbelow with reference to the exemplary embodiments illustrated in the drawing, in which:

FIG. 1 shows an illustration, in detail form, of a filter piston apparatus according to the invention, FIG. 2 shows an exploded illustration of the hollow-cylindrical body which is present in the filter piston apparatus according to FIG. 1 and of the additional parts of this body, namely its outer O-ring and its inner filter, FIG. 3 shows a schematic illustration of a metering roller with a filter piston apparatus according to the invention, FIG. 4 shows a schematic illustration of a metering tube with a filter piston apparatus according to the invention, FIG. 5 shows a longitudinal section, in detail form, through the hollow-cylindrical body according to FIG. 2, FIG. 6 shows a section through the filter according to FIG. 2, FIG. 7 shows a section along line 7—7 in FIG. 5, FIG. 8 shows a plan view of the filter according to FIG. 6, FIG. 9 shows a metering piston according to FIG. 2 with its metering chamber oriented downward, with a filter inserted and with an air hose introduced into the piston as far as the rear side of the filter, FIG. 10 shows an illustration similar to that of FIG. 9, with a piston which is closed by a head and through the head opening of which an air hose projects.

WAYS OF IMPLEMENTING THE INVENTION

Figure 11:
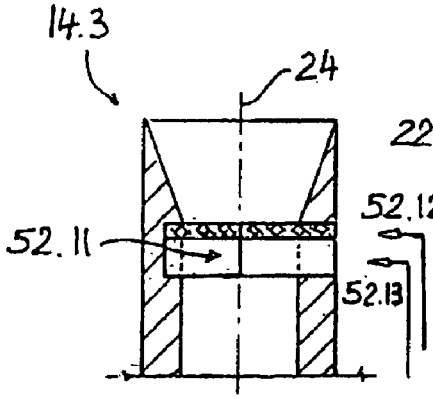
FIG. 11 shows a longitudinal section, in detail form, through another hollow-cylindrical body, a multi-layer filter being seated in the transverse slot thereof.

A filter piston apparatus 10, which may be designed in the manner of a metering roller (FIG. 3) or in the manner of a metering tube (FIG. 4) , has one or more circular-cylindrical bores 12, within which in each case one metering chamber 13 is formed (FIG. 1). Within the metering chamber 13, pulverulent bulk material is taken in by negative pressure and blown out into an available container by means of positive pressure. This method of operation of so-called vacuum filling systems with filter piston apparatuses is known in principle.

A hollow-cylindrical piston 14 is seated in each circular cylindrical bore 12, which is present for the purpose of forming a metering chamber 13. This piston is produced from a piece of tube with, in the present example, a circular cross section. The tube wall is beveled conically at one end 16 of the tube, with the result that the interior of the single-piece tube and thus also of the piston 14 widens in the direction of the end 16 as a result of a conical widening 18. A mouth 20 of the piston 14 at the end 16 of the latter is sharp-edged.

As a further contrast to a conventional tube, the piston 14 has, at the end of the conical widening 18, a transverse slot 22, which in the present case cuts open half of the tube or the piston 14 from the outside perpendicularly to the longitudinal axis 24 (FIGS. 5 and 7). The constantly thick casing 26 of the piston 14 is thus cut open by the transverse slot 22. In the present example, the casing 26 is cut open over half its circumference. In the circumferential half 30 of the casing 26 which is not cut open, the transverse slot 22 extends into an inner groove 32 formed in the casing 26. In the region of the inner groove 32, the casing 26 is thinner, by the groove depth 34 (FIG. 5), than in the rest of the region of the casing 26, with the exception of the end 16 with the conical widening 18 of the piston interior.

As a further contrast to a piece of tube, the piston 14 has an encircling transverse groove 36 which runs around the outside of the casing 26 in order to accommodate an O-ring 40. The O-ring 40 seals the gap 42 which is present between the piston 14 and the bore 12.

In the present example, such a piston 14 is seated in four circumferentially distributed circular-cylindrical bores 12 of a metering roller 44, which is part of the filter piston apparatus 10 according to FIG. 3.

The metering roller 44 can be driven in a rotatable manner, in the direction of rotation 47, about its central axis of rotation 46. Part of the circumference of the metering roller 44 is in contact with the base region of a store 48 for pulverulent bulk material 50. With a cylindrical bore 12 in the twelve o'clock position, it is possible for pulverulent bulk material 50 to flow out of the store 48 from above into the cylindrical bore 12 positioned beneath the base opening of the metering roller and into the piston 14, as far as the filter 52 seated in the transverse slot 22 and the inner groove 32. This inflow of the bulk material is assisted by an agitator 56, which can be driven in rotation in the store 48. Moreover, through the filter 52, a negative pressure is generated at least in the region of the conical widening 18, and bulk material is thus taken into the region of the filter 52 in the downward direction from the store 48.

The space within the piston 14 between the mouth 58 of the bore 12 and the filter 52 constitutes the metering chamber 13. The volume of the metering chamber 13 corresponds to the quantity of bulk material which is to be dispensed in portions in each case. The operation of emptying the contents of the metering chamber 13 into a container 62 takes place by virtue of the filled metering chamber or of the corresponding circular cylindrical bore 12 and thus of the metering roller 44 being rotated through 180 degrees in the direction of rotation 47; the metering roller 44, with its corresponding circular cylindrical bore 12 and its piston 14, rotated from its twelve o'clock position into its six o'clock position makes it possible, by virtue of a positive pressure being applied to the other side of the filter 52 to the metering chamber 13, for the plug of bulk material which is retained in the metering chamber 13 by suction force to be ejected into the container 62 provided beneath. By subsequent further rotation in the direction of rotation 47, it is then possible for the metering chambers 13 which are formed in the other bores 12 to be filled one after the other with bulk material 50 and for their corresponding plugs of bulk material then to be emptied one after the other into available containers 62.

The metering tube 70 which is illustrated in FIG. 4 is designed in the manner of a tubular pipette. The metering tube 70 has a circular cylindrical interior space 72, in which the piston 14 is seated, as is illustrated, in principle in FIG. 4. The interior space 72 between the filter 52, which is seated in the piston 14, and the mouth 58 of the bore 12 of the metering tube 70 bounds the metering chamber 13 at the bottom and top. The metering chamber 13, and thus the interior space 72, is bounded laterally, on the one hand, by the end 16 of the piston 14 with its conical widening 18 and also by the adjoining inside 74 of the casing wall of the metering tube 70.

For filling purposes, the metering tube 70 is submerged from above in a bed 76 of bulk material stored in an available store 78. From the bed 76 of bulk material, bulk material 50 is then taken into the interior space 72 as far as the filter 52. The metering tube 70 is then pulled out of the bed 76 of bulk material in the upward direction and positioned above a container 62. By virtue of a blowing-out operation, that is to say by virtue of a positive pressure being applied in the region of the interior space 72, the plug of bulk material which has been sucked in there is then blown out into the container 62. Before the metering tube 70 is pulled out of the bed 76 of bulk material, the metering tube 70 can first of all be displaced laterally in the bed 76 of bulk material in order for bulk material 50 which adheres to the mouth 58 to be removed, that is to say in order for excess bulk material to be sheared off from the sucked in (plug of) bulk material and thus removed.

In the case of both the metering roller 44 and the metering tube 70, bulk material is introduced into the respective metering chamber 13, separated off from the stored bulk material, transported to the container which is to be filled, and transferred into the container.

The dispensing processes of such filter piston systems pose various difficulties. Fine-grained powders with a grain diameter of less than 100 micrometers in particular tend, on account of interparticular forces of adhesion which are significantly greater than the weight-induced forces of gravity, to settle on surfaces. Attempts thus have to be made for the entire plug surface which is present during the ejecting operation of the plug of bulk material and is to be subjected to shearing stress to be subjected to the action of air pressure in order to make it possible for the particles of powder which are present in the plug to be constantly accelerated out of the metering chamber. It is only then that accumulations of material which would vastly impair the accuracy of the dispensing system do not remain behind in the metering chamber.

Bulk materials in the form of fine-grained products as arise in the case of pharmaceutical bulk materials in the form of powder inhalants in particular, have grain sizes of less than 5 micrometers. Such small grain sizes are necessary for powder inhalants in particular, in order that these pharmaceuticals can reach the therapeutically important lung regions, for example, when inhaled. For reasons relating to medical hygiene, it is thus necessary for filter pistons, or the filter elements thereof, which come into direct contact with product to be regularly cleaned or exchanged. Such filter piston systems should thus be extremely easy to clean. If cleaning is not possible, the systems have to be easy to assemble and dismantle, which renders correspondingly inexpensive system parts necessary.

As far as a high performance of the filter piston apparatus is concerned, in particular in the case of metering-roller designs, the time taken to build up a vacuum and a positive pressure, and thus the period of time which is required for sucking in bulk material and for blowing out bulk material, are of particular interest. This is because the metering rollers preferably rotate at a continuous speed. The speed of rotation is limited by the period of time which is required for filling the metering chamber moving past the base opening of the store. The same applies to the filled metering chamber moving past the container which is to be filled. The filter which is present in the piston 14 should thus allow a sufficiently high level of air or gas throughflow. It is necessary here, however, for the effective pore size of the filter to be smaller than the grain size of the bulk material which is to be dispensed.

The porosity of the filter, however, could be selected to be greater than the grain sizes of the smallest particles of the bulk material 50 if the fines in the bulk material attach themselves to larger particles of the bulk material or if such components agglomerate with one another, with the result that the individual fines cannot pass into the filter of their own accord.

The filter 52 which is illustrated in FIGS. 6 and 8 consists of a metal fabric which has a number of layers joined together. The fabric comprises a plurality of layers 52.1, 52.2, 52.3. The pore size of these three layers decreases from coarse (52.1) to very fine (52.3), the layer with the finest pores 52.3 being directed toward the conical widening 18 and thus constituting that side of the filter 52 which is in contact with the bulk material 50. This filter 52 has such a thickness 80 that it can be pushed into the transverse slot 22 and into the inner groove 32 of the piston 14 and can be seated sufficiently firmly in the piston 14.

On account of the shape of the transverse slot 22 and of the inner groove 32, the filter 52 has a surface area which is made up of two partial circles. The larger, right-hand partially circular surface 52*a* which is illustrated in FIG. 8 has a radius 82 which, in the present example, corresponds to the external radius 84 of the piston 14. The left-hand partially circular surface 52*b* in FIG. 8 has a radius 86 which corresponds to the internal radius 88 of the inner groove 32. The two partially circular surfaces 52*a*, 52*b* constitute semicircles in plan view, with the result that, in the inserted state, which is illustrated in FIGS. 9 and 10, the filter 52 terminates flush with the outside of the respective piston 14 or 14.2 and is thus seated, in its entirety, in the inner groove 32 and in the transverse slot 22. That cross-sectional surface of the casing 26 which is not illustrated by hatching in FIG. 7 is fully covered by the filter 52 in the state in which the latter is seated in the piston 14, 14.2. At the same time, the interior 90 of the piston 14, 14.2 is also closed by the filter 52 in an air-permeable or gas-permeable but powder-impermeable manner.

In the state in which it is seated in the piston 14, the filter 52, and this applies to all the filter embodiments mentioned hereinbelow, has its circumferential periphery covered to the same extent on both sides in the axial direction, that is to say in the direction of the longitudinal axis 24, by parts of the casing 26 both in the region of the transverse slot 22 and in the region of the inner groove 32. As, for example, FIG. 10 illustrates, the portion of the circular filter surface 52A, which is directed toward the conical widening 18, is equal to the rear circular surface 52B of the filter 52. It is thus possible for the bulk material which is taken in on the filter surface 52A to be subjected uniformly to the action of air during the blowing out operation and thus for the entire surface 52A to be freed of taken-in bulk material during emptying of the metering chamber. The situation where accumulations of powder settle in the peripheral region 92 of the filter 52 is avoided. The conical widening 18 and the sharp edged mouth of the piston 14.2 (FIG. 10) assist in the operation of blowing out all of the plug of bulk material taken in in front of the filter 52.

Whereas the piston 14.2 which is illustrated in FIG. 10 is closed on the rear side of the filter 52 by a piston head 94, the piston 14 is fully open in this rear region (FIG. 9). Projecting through the piston head 94 is a gas hose 96, which terminates in the interior of the piston 14.2 at an axial distance from the filter 52. Through this gas hose 96, it is possible to generate, within the metering chamber, the negative pressure which is necessary for sucking in the bulk material and the positive pressure which is necessary for blowing out bulk material.

In the case of the piston 14 which is illustrated in FIG. 9, such a gas hose 96 projects as far as the filter 52. In this way, on the one hand, the piston 14 is very straightforward to produce from a piece of tube and, on the other hand, the gas hose 96, which generally permits a certain amount of elastic deformation in its transverse direction, can be fastened sufficiently firmly on the inner wall of the casing 26 by virtue of being compressed slightly. In the present case, the gas hose 96 has been advanced as far as the filter 52. It can thus assist the fixed, axially captive abutment of the filter 52 in the transverse slot 22 and in the inner groove 32. In view of the fact that the filter 52 has a relatively pronounced thickness 80 and the gas hose 96 has a hose wall 98 of relatively small thickness 99, the fact that the presence of the hose wall 98 renders the rear filter surface slightly smaller than the front side can be ignored. It would also be possible, if appropriate, for the gas hose 96 to terminate in the piston 14 at a small axial distance from the filter 52.

Figure 12:
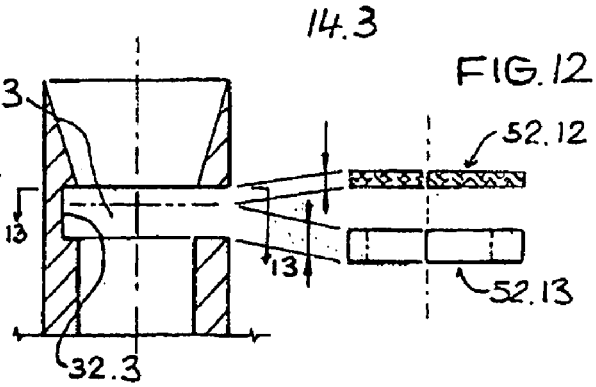
FIG. 12 shows a section through the multi-layered filter according to FIG. 11.
Figure 15:
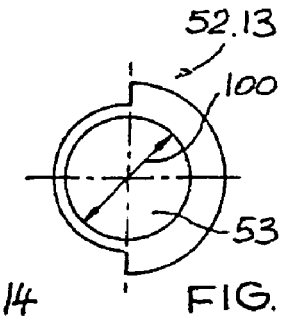
FIG. 15 shows a plan view of a second layer of the filter according to FIGS. 11 and 12.

In the case of the piston 14.3 which is illustrated in FIGS. 11 and 12, the transverse slot 22.3 and its inner groove 32.3 are of such a magnitude in the axial direction, that is to say in the direction of the longitudinal axis 24, that a two-layered filter 52.11 can be pushed into the transverse slot and into the inner groove in a manner comparable to the filter 52. The filter 52.11 has a filter medium 52.12 and a supporting body 52.13. The filter medium 52.12 may be constructed in the same way as the filter 52. It is also possible, however, to select a single-piece layer here (in contrast to the filter 52) consisting of an elastically deformable and thus compressible layer material. Such a layer material may be felt material, nylon fabric or the like. It would be possible, in this case for the supporting body 52.13 to be non-elastic and of relatively large-pored or lattice-like design, since it is only the filter medium 52.12, which constitutes that side of the filter 52.11 which is in contact with the bulk material, which would have to be sufficiently impermeable to product. The supporting body 52.13 could thus be designed, for example, in the form of a ring with a central opening 53 (FIG. 15). The diameter 100 of this opening 53 would correspond to the internal diameter 102 of the piston 14.3 in the region of the transverse slot 22.3. It would also be possible for the diameter 100 to be somewhat larger, but no smaller, than the internal diameter 102, in order not to reduce the size of the free inner cross section of the piston 14.3.

In this example, once again, the filter medium 52.12 has the shape in plan view which can be seen from FIG. 8, and comprises two partially circular surfaces 52*a*, 52*b*, with a larger and a smaller semicircular surface.

Figure 13:
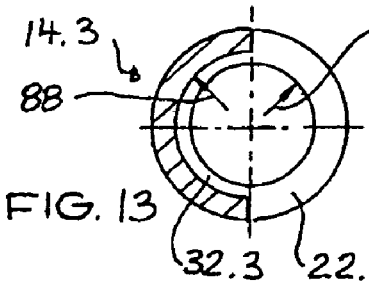
FIG. 13 shows a section along line 13—13 in FIG. 12.
Figure 14:
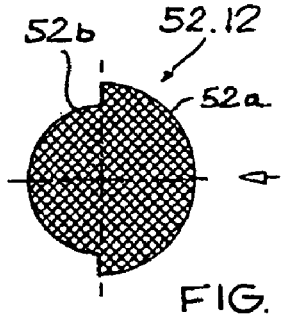
FIG. 14 shows a plan view of a first layer of the filter according to FIGS. 11 and 12.
Figure 16:
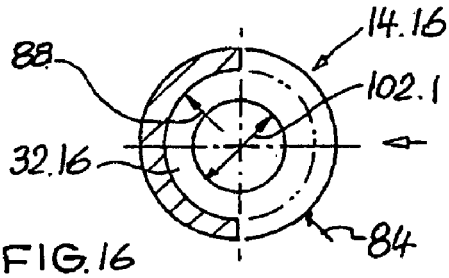
FIG. 16 shows a further-modified illustration of a piston in the region of its slot and of its transverse groove, similar to the illustration of FIG. 7, for a multi-layered filter.
Figure 17:
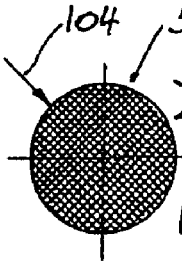
FIG. 17 shows a plan view of a first layer of a further filter.
Figure 18:
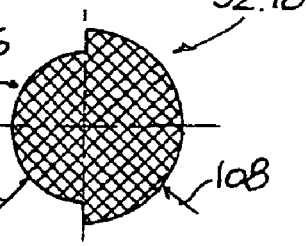
FIG. 18 shows a plan view of a second layer of the further filter.

In the case of the configuration which is illustrated in FIGS. 16, 17 and 18, a piston 14.16 contains a filter 52.16 which comprises two layers of a filter medium 52.17 and 52.18. The filter-medium layer 52.17 constitutes that side of the filter 52.16 which is in contact with the product, and it has finer pores than the other, second filter-medium layer 52.18. The filter 52.16 is formed by the two layers located one above the other. The surface of the filter-medium layer 52.17, as seen in plan view, is a circular surface with the radius 104, which corresponds to the internal radius 106 of the inner groove 32.16. The second filter-medium layer 52.18 is in the form of two partially circular surfaces, which is known from FIGS. 2, 8 and 14. The radius 108 of the larger partially circular surface (semicircle) corresponds, in turn, to the external radius 84 of the piston 14, while the radius 110 of the smaller partially circular surface (semicircle) corresponds to the internal radius 88 of the inner groove 32.16 which is present. The internal diameter 102.1 of the piston 14.16 is smaller by comparison with the internal diameter 102 of the piston 14.3 (FIG. 13).

Figure 19:
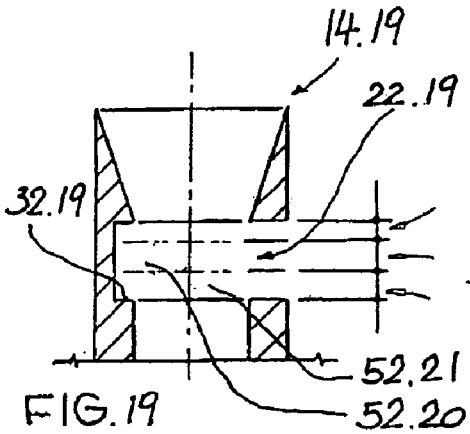
FIG. 19 shows a further modification of the transverse slot and of the transverse groove for a further piston of a filter piston apparatus according to the invention.
Figure 20:
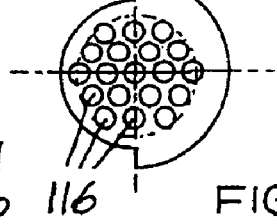
FIGS. 20 and 21 show two further different layers of a further multi-layered filter according to the invention.
Figure 21:
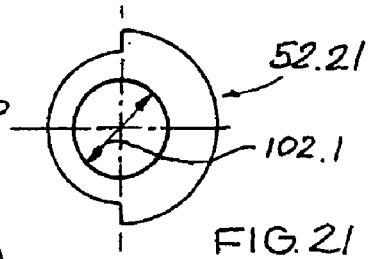

In the case of the piston 14.19 as illustrated in FIG. 19, a filter comprising three layers can be pushed into the transverse slot 22.19 and the inner groove 32.19. A lowermost layer of such a filter, as seen in FIG. 19, may comprise a supporting body 52.21 (FIG. 21). It is possible to provide above the latter a lower filter medium layer 52.20 (FIG. 20), which would then be present as the central of three layers. This filter medium layer 52.20 has relatively large pores 116, with the result that this filter-medium layer 52.20 forms a coarse-pored filter layer. A fine-pored filter-medium layer, for example configured like the filter-medium layer 52.12 of FIG. 14, could be provided above the coarse-pored layer. The two filter-medium layers 52.20 and 52.21 have identical outlines.

Of course, instead of the three layers, it would also be possible for fewer or more than three layers to be placed in a stack one above the other as a common filter in a transverse slot and in an inner groove of a piston. The plurality of layers of a filter could be present as an interconnected filter design and thus, in respect of the handling thereof, as a single piece. It would also be possible, however, for the filter layers to be handled separately and individually and thus to be pushed individually into a piston in order for it to be possible, in accordance with the respective bulk material, for better account to be taken of the different filter conditions. It is thus possible for a less fine-grained bulk material to allow the use of coarser filters than would be the case with finer-grained bulk materials. Since the dispensing speed also depends on the quantity of air throughput through the filter, it would thus be possible for the operating speed during the operation of dispensing coarser bulk materials to be comparatively higher than in the case of comparatively fine-grained bulk materials.

In terms of material, the filters or individual filter layers could consist of sintered metal or sintered glass.

In the examples illustrated, the filter-medium layer or the filter in the respective filter layer is of identical design throughout. It would also be possible for the encircling peripheral region of the filter or of the filter-medium layer which is covered by the casing wall of the piston in each case to be of air-impermeable design. This could prevent bulk material from being able to penetrate into these peripheral regions of the filter or of the filter layers, these regions constituting metering-chamber regions which are relatively difficult to control, in which case the dispensing accuracy of the filter piston apparatus could be impaired.

Figure 22:
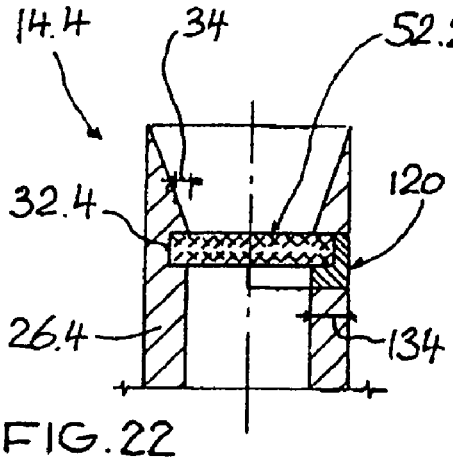
FIG. 22 shows a longitudinal section, in detail form, through a further hollow-cylindrical body, a filter and, in addition, a sealing element being seated in the transverse slot thereof.
Figure 23:
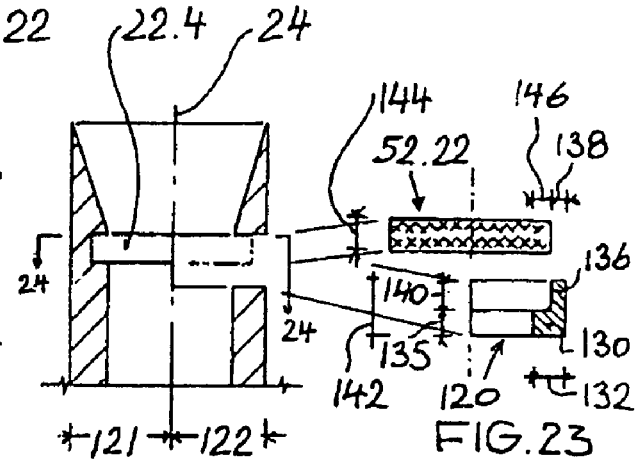
FIG. 23 shows a section through the filter and through the sealing element according to FIG. 22.
Figure 24:
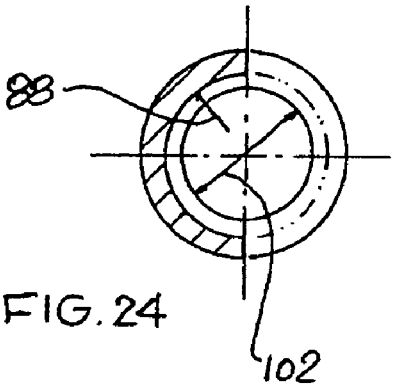
FIG. 24 shows a section along line 24—24 in FIG. 23.
Figure 25:
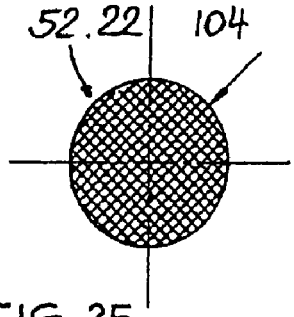
FIG. 25 shows a plan view of the filter according to FIGS. 22 and 23.

FIG. 22*ff* illustrates a piston 14.4 in the case of which the radially outer end surface of the filter 52.22 thereof is sealed in relation to the outside of the piston 14.4. This sealing takes place by means of a sealing element 120.

Like the abovedescribed piston, the piston 14.4 has a transverse slot 22.4, into which an entire filter 52.22 can be pushed from outside the piston 14.4, from the direction perpendicular to the longitudinal axis 24. In the left-hand half of the cross section, that is to say in the left-hand half 121 in relation to the longitudinal axis 24, the transverse slot 22.4 is of a design that corresponds, for example, to the abovedescribed transverse slot 22 of FIG. 2. The casing 26.4 of the piston 14.4 thus contains, in the region 121, a groove 32.4, in which the filter 52.22 is seated tightly in its pushed-in state. In the right-hand half 122 of the cross section, as seen in relation to the longitudinal axis 24, the transverse slot widens in the direction of the longitudinal axis 24. In this right-hand region 122 of the cross section, there is thus space, on the one hand, for the filter 52.22 and, in addition, for the sealing element 120.

Figure 26:
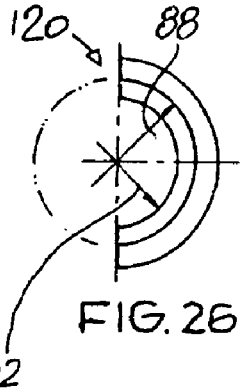
FIG. 26 shows a plan view of the sealing element according to FIG. 23.

The sealing element 120 is of angled design in cross section. It extends along a semicircular ring, as FIG. 26 illustrates. A circumferentially semicircular ring section 130, of which the width 132 corresponds to the thickness 134 of the casing 26.4 and which has an axial height 135, is followed by a semicircular ring section 136 with a width 138 and an axial height 140. The overall axial height 142 of the sealing element 120 is thus made up of the height 135 of the circular ring section 130 and of the height 140 of the circular ring section 136. In this case, the height 140 corresponds to the thickness 144 of the filter 52.22 in its seated state. The amount by which the semicircular ring section 136 is set back 146 in relation to the semicircular ring section 130 corresponds, in the present example, to the groove depth 34 at which the filter 52.22 is seated in the inner groove 32.4. The radius 104 of the filter 52.22 thus corresponds, in terms of magnitude, to the radius of the first filter medium 52.17 of FIG. 17. Accordingly, the internal radius 88 of the inner groove 32.4 corresponds to the corresponding internal radius of the piston 14.16 which is illustrated in FIG. 16. The internal diameter 102 of the piston 14.4 corresponds to the internal diameter on which the sealing element 120 is based. The interior space which is surrounded in semicircular form by the sealing element 120 thus corresponds to the interior of the piston 14.4.

The annular gap which is present outside the piston 14.4 can be effectively closed by the sealing element 120, with the result that extremely fine-grained bulk material (powder) is not sucked through the annular gap into the filter 52.22 from the outside—for example when a vacuum is applied for the purpose of sucking the powder into the metering chamber. Otherwise, the filter 52.22 could block laterally, or the sealing action of the filter could decrease. The sealing element helps to achieve sufficient sealing of the filter on its radially outer side in the region of the transverse slot.

The invention claimed is:

1. A filter piston apparatus for dispensing respectively predetermined volumes of pulverulent bulk material, the filter piston having:

a hollow-cylindrical piston arranged in a circular-cylindrical bore, a filter which is formed as a plate and is permeable to gas but impermeable to the bulk material, and a metering chamber which accommodates a predetermined volume of bulk material, is present at the end of the circular-cylindrical bore and has a base formed by the filter, the metering chamber being further configured to be attached to a positive-pressure or negative-pressure gas source through the filter, wherein a circumferential wall of the piston has a transverse slot and an inner groove located radially opposite the transverse slot, such that the filter can be pushed at an exterior surface of the circumferential wall of the piston into the slot until the filter is seated in the piston, such that the filter is secured in the slot on both sides of the filter, in the axial direction of the piston, along a peripheral edges of the filter.

2. The filter piston apparatus as claimed in claim 1, wherein the filter is secured on both sides in the axial direction in the slot by the circumferential wall of the piston.

3. The filter piston apparatus as claimed in claim 1 or 2, wherein the circumferential wall of the piston is connected integrally on both sides of the filter in the axial direction.

4. The filter piston apparatus as claimed in claim 1 or 2, wherein the circumferential wall of the metering chamber, within the piston, has a frustoconical widening which increases in cross section in a direction moving from the filter toward a mouth of the piston.

5. The filter piston apparatus as claimed in claim 1 or 2, wherein a tight seal for the bulk material, designed in particular as an O-ring, is present between the circumferential wall of piston and the circular-cylindrical bore.

6. The filter piston apparatus as claimed in claim 5, wherein the O-ring is seated in an encircling transverse groove in the circumferential wall of the piston.

7. The filter piston apparatus as claimed in claim 1 or 2, wherein the filter has in cross section, at least in one sub-region, a partially circular surface of which the radius is no larger than the internal radius of the piston in the region of the inner groove.

8. The filter piston apparatus as claimed in claim 1 or 2, wherein the filter has in cross section at least two partially circular surfaces of which the radii are of different magnitudes such that the filter can be pushed into the inner groove by way of the partially circular surface having the radius of smaller magnitude.

9. The filter piston apparatus as claimed in claim 8, wherein the circumferential angle of the smaller partially circular surface is less than or equal to 180 degrees.

10. The filter piston apparatus as claimed in claim 8, wherein the radius of the larger partially circular surface is approximately equal to the external radius of the piston.

11. The filter piston apparatus as claimed in claim 7, wherein the radius of the smaller partially circular surface is approximately equal to the internal radius of the inner groove.

12. The filter piston apparatus as claimed in claim 7, wherein the filter has in cross-section a radius which is no larger than the internal radius of the piston in the region of the groove base.

13. The filter piston apparatus as claimed in claim 1 or 2, wherein the filter comprises a non-elastic material selected from the group consisting of sintered glass and sintered metal.

14. The filter piston apparatus as claimed in claim 13, wherein the thickness of the filter in the axial direction is adapted to the axial height of the transverse slot and of the transverse groove, such that it can be press fit in and out of the transverse slot and the transverse groove of the piston.

15. The filter piston apparatus as claimed in claim 1 or 2, wherein the filter further comprises a support with an attached filter medium.

16. The filter piston apparatus as claimed in claim 15, wherein the filter medium comprises a non-elastic material selected from the group consisting of sintered glass and sintered metal.

17. The filter piston apparatus as claimed in claim 1 or 2, wherein the filter comprises a plurality of differently permeable, porous filter layers, a filter layer having the finest pores is positioned as the closest filter layer to the interior of the metering chamber.

18. The filter piston apparatus as claimed in claim 1 or 2, wherein the filter is elastically compressible, and the thickness and compressibility of the filter in the axial direction is such that it can be a press fit into the transverse slot and the transverse groove.

19. The filter piston apparatus as claimed in claim 1 or 2, wherein the filter comprises felt material.

20. The filter piston apparatus as claimed in claim 1 or 2, wherein the filter comprises nylon fabric.

21. The filter piston apparatus as claimed in claim 1 or 2, wherein the filter further comprises a support which retains a filter medium, such that the support has a dimensionally stabilizing effect on the filter medium.

22. The filter piston apparatus as claimed in claim 1 or 2, wherein a radially outer surface of the filter is impermeable to bulk material, at least in a region of filter that is positioned in the transverse slot.

23. The filler piston apparatus as claimed in claim 22, wherein a sealing element which is impermeable to bulk material encloses the radially outer surface of the filter at least in the region positioned in the transverse slot.

24. The filter piston apparatus as claimed in claim 23, wherein the sealing element is angled in cross section, with a first circular-ring section for positioning the radially outer surface of the filter, and with a second circular-ring section, which is fixed to the first circular-ring section, and for which a thickness of the second circular-ring section in a direction transverse to the axial direction is no greater than the thickness of the casing of the piston in the transverse direction.

* * * * *